US009140143B2

(12) United States Patent
Schule et al.

(10) Patent No.: US 9,140,143 B2
(45) Date of Patent: Sep. 22, 2015

(54) METHOD OF OPERATING A STEAM POWER PLANT AT LOW LOAD

(71) Applicant: ALSTOM Technology Ltd, Baden (CH)

(72) Inventors: Volker Schule, Leimen (DE); Julia Heintz, Gernsheim (DE); Stephan Hellweg, Otigheim (DE)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 13/668,224

(22) Filed: Nov. 3, 2012

(65) Prior Publication Data

US 2013/0305722 A1 Nov. 21, 2013

(30) Foreign Application Priority Data

Nov. 3, 2011 (EP) ..... 11187593

(51) Int. Cl.

| | |
|---|---|
| ***F01K 7/34*** | (2006.01) |
| ***F01K 7/22*** | (2006.01) |
| ***F01K 7/16*** | (2006.01) |
| ***F01K 7/02*** | (2006.01) |
| ***F01K 13/02*** | (2006.01) |
| ***F01K 17/06*** | (2006.01) |

(52) U.S. Cl.
CPC ... *F01K 7/16* (2013.01); *F01K 7/02* (2013.01); *F01K 13/02* (2013.01); *F01K 17/06* (2013.01)

(58) Field of Classification Search
CPC .... F01K 7/22–7/24; F01K 7/16; F01K 17/06; F01K 7/02; F01K 13/02; F22G 5/18
USPC ..... 60/645–681
See application file for complete search history.

(56) References Cited

U.S. PATENT DOCUMENTS

| | | | | |
|---|---|---|---|---|
| 3,035,556 | A * | 5/1962 | Brunner | 122/476 |
| 3,338,053 | A * | 8/1967 | Gorzegno et al. | 60/646 |
| 3,769,942 | A * | 11/1973 | Brehler | 122/479.7 |
| 4,693,086 | A * | 9/1987 | Hoizumi et al. | 60/663 |
| 5,335,252 | A | 8/1994 | Kaufman | |
| 6,263,662 | B1 | 7/2001 | Nagashima | |
| 6,397,575 | B2 * | 6/2002 | Tomlinson et al. | 60/783 |
| 2009/0090111 | A1 * | 4/2009 | Tomlinson et al. | 60/783 |
| 2009/0260585 | A1 | 10/2009 | Hack et al. | |
| 2011/0120130 | A1 * | 5/2011 | Mishima et al. | 60/660 |

FOREIGN PATENT DOCUMENTS

| | | |
|---|---|---|
| EP | 0743425 A1 | 11/1996 |
| EP | 2333255 A2 | 6/2011 |

OTHER PUBLICATIONS

European Search Report, EP Application No. 11187593.6, Date Mailed May 25, 2012, 6 pages.

* cited by examiner

*Primary Examiner* — Hoang Nguyen
(74) *Attorney, Agent, or Firm* — Robert D. Crawford

(57) ABSTRACT

A method for operating a steam power plant at low load is suggested comprising the extraction of live steam LS before the last superheater SH3 and/or resuperheated steam before the last resuperheater RSH2 and using the thermal energy of this steam in other heat sinks. Thus, nearly constant steam parameters of the live steam LS are achieved and the overall efficiency of the steam power plant remains at a high level.

11 Claims, 4 Drawing Sheets

METHOD OF OPERATING A STEAM POWER PLANT AT LOW LOAD

Figure 1:
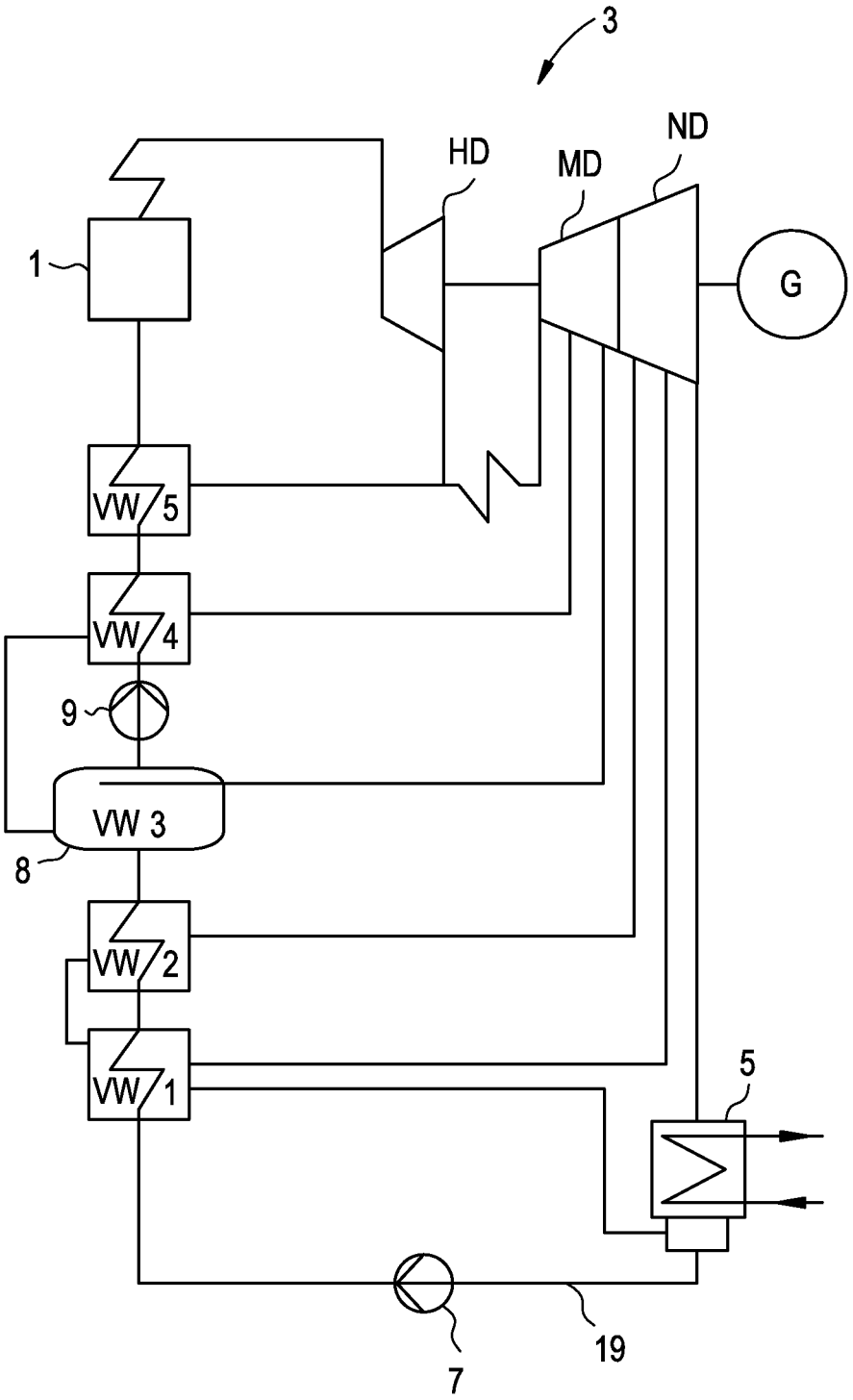

If a steam power plant is operated at low load several boundary conditions, including economic and efficiency aspects, have to be met.

From U.S. Pat. No. 4,870,823 it is known to operate a steam turbine at very low load by moving the throttle point from the turbine valves into the boiler. Since no energy is recovered this method is sub-optimal with regard to costs and efficiency.

If steam generators (e.g. if it is operated with constant pressure of the live steam) are operated below a certain level of load initially the temperature $T_{HRN}$ at the outlet of the hot reheater (also referred to as intermediate superheater) sinks and with further load reduction the live steam temperature $T_{LS}$ decreases as well.

It is the object of the invention to provide a method to operate a steam power plant at low load that is more efficient and thus more attractive from the economic and environmental aspect.

This objective is achieved by the methods claimed in the independent claims 1 and 3.

The methods according to claims 1 and 3 allow to maintain the maximal live steam temperature ($T_{LS}$) and the hot reheater temperature $T_{HRH}$ can be maintained with very low loads of the turbine as well.

With these methods the change of temperatures during operation at different loads become minimal for the steam generator.

If steam is tapped only between the superheaters the influence on the temperature $T_{HRN}$ at the outlet of the hot reheater is minimised.

If steam is tapped upstream of the last subcooler RHS2 the temperature of the live steam remains. This effect could be used, to stabilize the temperature $T_{HRN}$ without effecting the temperature of the live steam.

The invention is well suited especially for the following applications:

Stabilizing the live steam temperature $T_{LS}$ at low load and high live steam pressure $p_{LS}$.

Stabilizing the hot reheater temperature $T_{HRH}$ at low load and with remaining/constant high live steam pressure.

Enabling higher load gradients from low load to full load.

Using the coupled-out energy for other processes (e.g. loading a thermal reservoir, drying brown coal or the like).

By using the energy of the extracted steam in one or more of the processes claimed in claim 6 the energy extracted from the steam generator is recovered and the overall efficiency of the processes involved increases. Consequently the energy demand and the emissions are reduced.

In order to counteract the Joule-Thomson-Effect at the control valves of Partial-Arc-Turbines the boiler pressure $p_{LS}$ can be reduced. The simultaneous increase of the temperature $T_{LS}$ to the maximal value reduces the cooling at the turbine control valve(s) in side the turbine. As through this operating mode, compared with steam generator plus turbine with variable pressure, a rather high live steam temperature is maintained and thus higher load gradients can also be applied to the steam power plant.

The claimed invention prevents also cooling of the boiler drum and superheaters (which happens when the plant is operated in gliding pressure mode).

Further advantages and advantageous embodiments of the invention can be taken from the following drawing, its specification and the patent claims. All features described in the drawing, its specification and the patent claims can be relevant for the invention either taken by themselves or in optional combination with each other.

FIGURES

Figure 2:
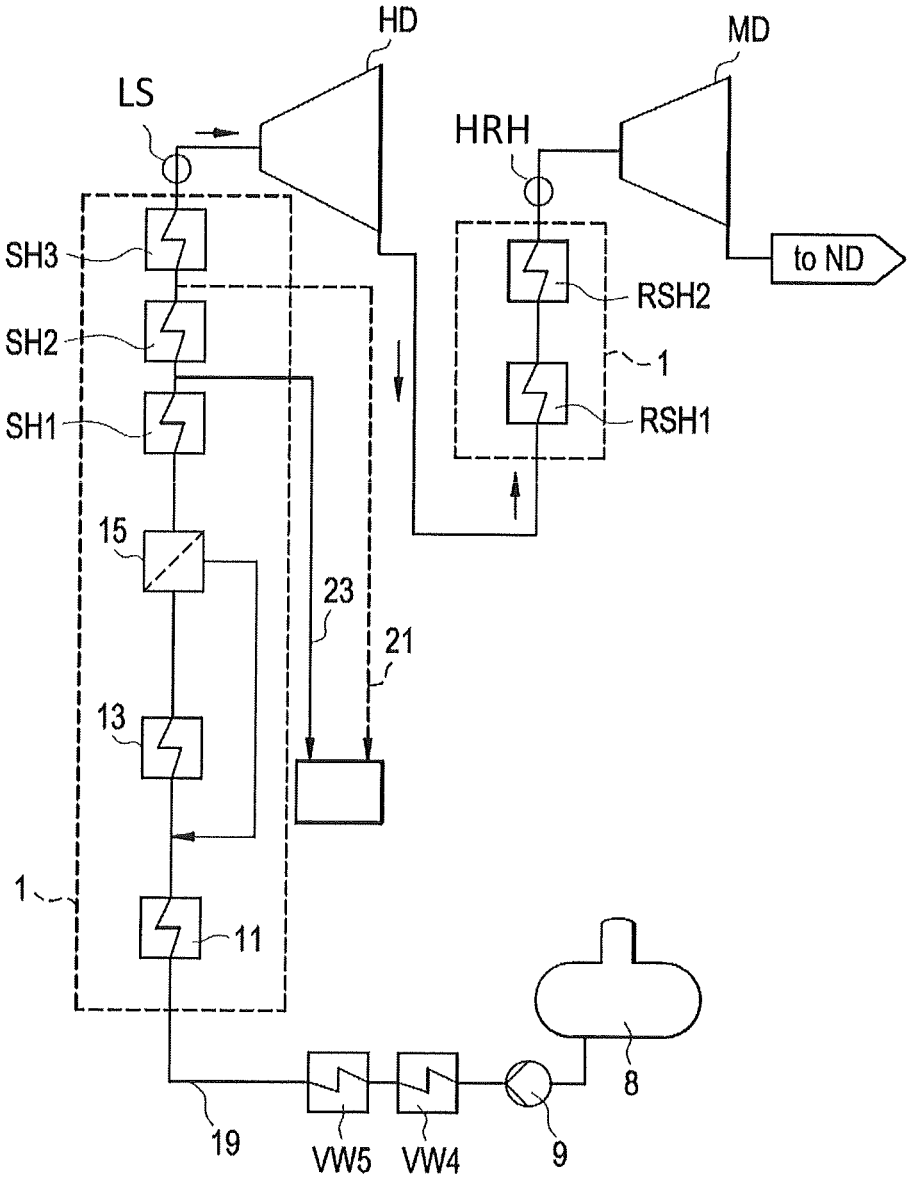
Figure 3:
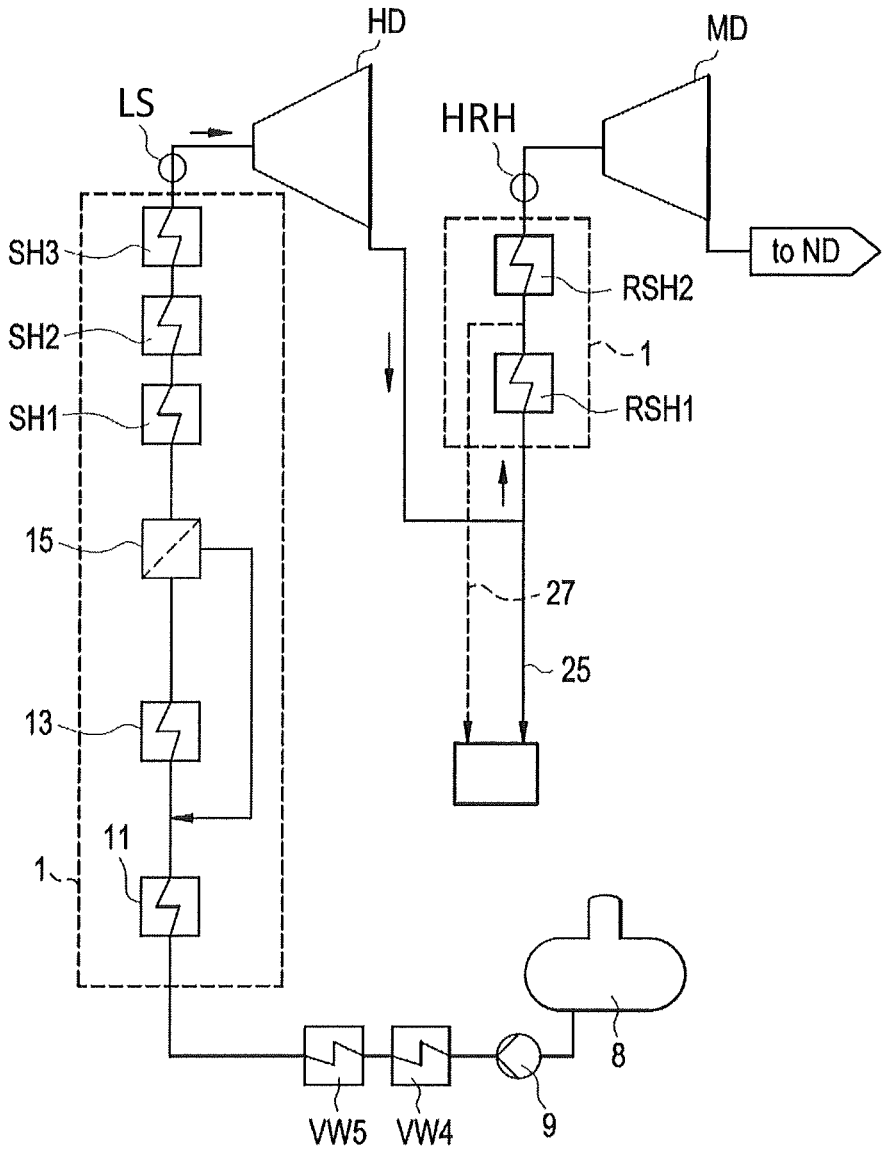

Shown are:

FIG. 1 A diagram of a conventional steam power plant,

FIG. 2 a first embodiment of the claimed method,

FIG. 3 a second embodiment of the claimed method, and

Figure 4:
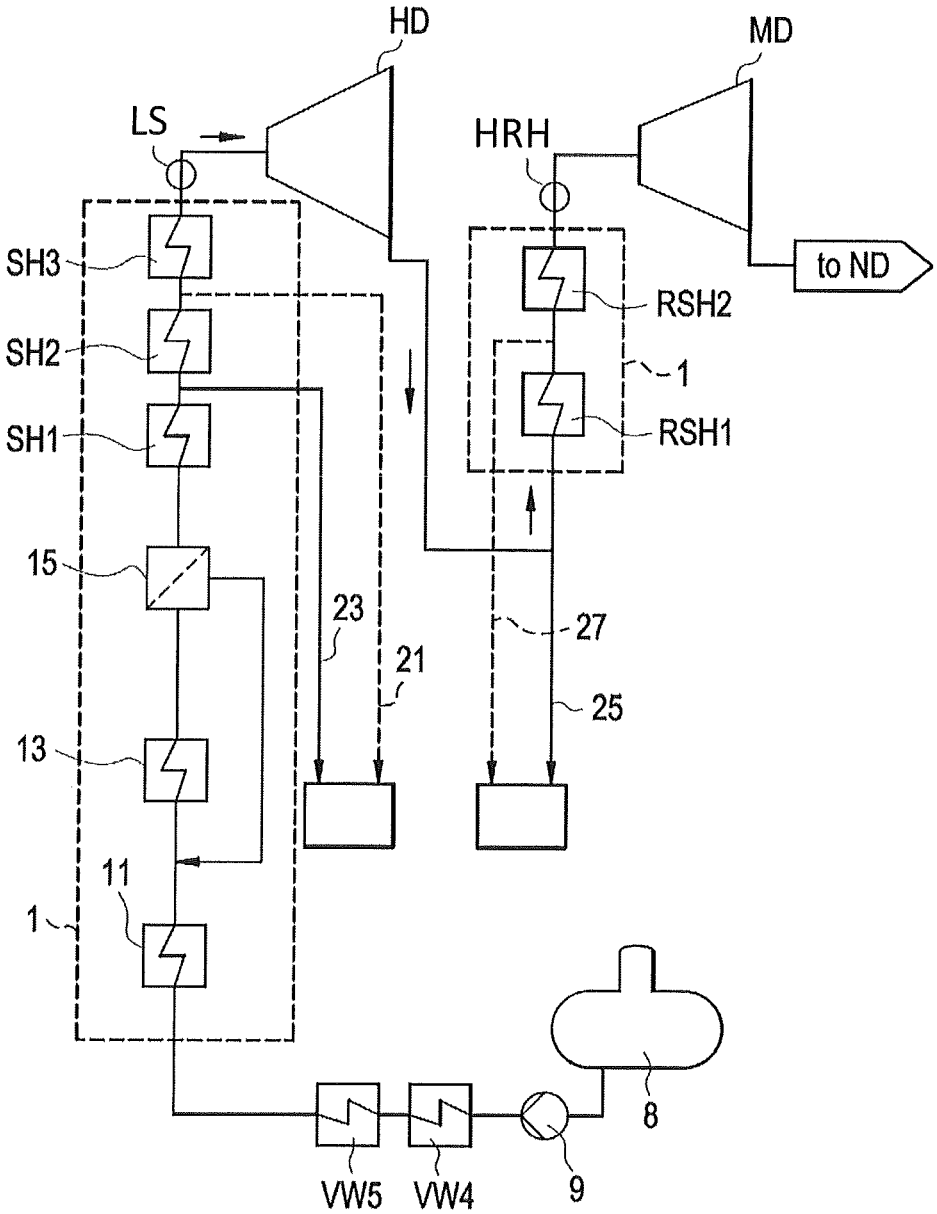

FIG. 4 a third embodiment of the claimed method.

SPECIFICATION OF THE EMBODIMENTS

In FIG. 1 a steam power plant fuelled with fossils or biomass is represented as block diagram. FIG. 1 essentially has the purpose of designating the single components of the power plant and to represent the water-steam-cycle in its entirety. For reasons of clarity in the following figures only those parts of the water-steam-cycle are represented which are essential to the invention.

In a steam generator 1 under utilization of fossil fuels or by means of biomass out of the feed water live steam is generated, which is expanded in a steam turbine 3 and thus drives a generator G. Turbine 3 can be separated into a high-pressure part HP, a medium-pressure part IP and a low-pressure part LP.

After expanding the steam in turbine 3, it streams into a condenser 5 and is liquefied there. For this purpose a generally liquid cooling medium, as e.g. cooling water, is supplied to condenser 5. This cooling water is then cooled in a cooling tower (not shown) or by a river in the vicinity of the power plant (not shown), before it enters into condenser 5.

The condensate originated in condenser 5 is then supplied, by a condensate pump 7, to several preheaters VW1 to VW5. In the shown embodiment behind the second preheater VW2 a feed water container 8 is arranged and behind the feed water container 8 a feed water pump 9 is provided.

In combination with the invention it is of significance that the condensate from condenser 5 is preheated with steam beginning with the first preheater VW1 until the last preheater VW5. This so-called tapping steam is taken from turbine 3 and leads to a diminution of the output of turbine 3. With the heat exchange between tapping steam and condensate the temperature of the condensate increases from preheater to preheater. Consequently the temperature as well of the steam utilized for preheating must increase from preheater to preheater.

In the shown embodiment the preheaters VW1 and VW2 are heated with steam from low-pressure part LP of steam turbine 3, whereas the last preheater VW5 is partially heated with steam from high-pressure part HP of steam turbine 3. The third preheater VW3 arranged in the feed water container 8 is heated with steam from medium-pressure part IP of turbine 3.

In FIGS. 2 to 4 various methods of operating a steam power plant according to the invention are illustrated. As the invention essentially is concerned with the steam generator 1 and the turbine 3 this part of the steam power plant is shown in FIG. 2 ff. Neither are, for reasons of clarity, all fittings and components in FIG. 2 ff. designated with reference numerals. The designation of the fittings and representation of the fittings and components corresponds to DIN 2482 "Graphic symbols for heat diagrams", which herewith is referred to, and are thus self-explanatory.

The steam generator 1 that is illustrated in FIG. 1 as a single black box is illustrated in FIGS. 2 to 4 in more detail. Inside a dotted line the components of the steam generator 1 are illustrated.

Following the feed water or condensate coming from the preheater VW5 it enters the steam generator 1 and passes an economizer 11, a evaporator 13, a separator 15 and several superheaters SH1, SH2 and SH3. The claimed invention is not limited to threes stages; it is applicable in cases where more than three stages exist.

In the evaporator 13 the condensate is heated and becomes saturated steam. In the separator 15 liquid particles are separated from the saturated steam and reefed into the condensate line 19 before the evaporator 13.

The live steam or life steam that leaves the last superheater SH is abbreviated with the letters LS. In FIG. 2 between the boiler 1 and the entrance of the high pressure part HP of the turbine 3 a circle with the reference LS can be seen. At this point the live steam parameters of the live steam LS, namely a pressure $p_{LS}$ and temperature $T_{LS}$, occur and can be measured by means of appropriate sensors (not shown).

Typically subcritical live steam has a pressure of approximately 160 bar ($p_{LS}$=160 bar) and a temperature of approximately 540° C. ($T_{LS}$=540° C.).

The live steam after having past the high pressure part HP of the turbine 3 has a reduced temperature and pressure and enters the reheater RSH1 and RSH2. This resuperheated steam HRH enters the intermediate pressure part IP of the turbine 3. The circle HRH in FIG. 2 illustrates a place where this hot superheated steam HRH occurs. The corresponding steam parameters HRH and HRH can be detected by a temperature sensor and/or a pressure sensor at this point if necessary.

Typically subcritical steam at the hot end of the reheater has a pressure of approximately 40 bar ($p_{HRH}$=40 bar) and a temperature of approximately 540° C. ($T_{HRH}$=540° C.).

If this steam power plant is operated at medium or high load it is operated in a way as it is known from the prior art.

As soon as the steam power plant is operated at low load, namely at a load below for example 30% of the maximum load, steam is extracted from the heat generator 1 before/upstream the last superheater SH3. This extraction is illustrated in FIG. 2 by a line 21. It is additionally possible to extract steam between the first super heater SH1 and the second superheater SH2 (c.f. line 23).

This extraction or tapping of superheated steam from the steam generator 1 leads to a reduced mass flow of steam through the superheater(s) downstream the extraction point. Due to that reduced mass flow the convective heat transport between the flue gas and the steam inside the superheaters downstream the extraction point is improved and therefore the achievable temperature is higher.

A further positive effect of this method is that even though a small mass flow of live steam LS enters the high part HP of the turbine 3 the temperature $T_{LS}$ of the steam remains constant. The same applies with regard to the pressure $p_{HP}$ of the steam. The throttling effect is reduced because compared to state of the art, the temperature is higher and the cooling of the turbine is reduced.

The high pressure steam extracted between the superheaters SH3 and SH1 may be used for loading a high temperature and/or a low temperature heat reservoir, for drying and fluidising coal, especially brown coal, for supplying one more of the preheaters with thermal energy and for running a separate steam turbine or a separate steam motor and for the energy supply of other industrial processes that are not part of the steam water cycle of the power plant.

In case a heat reservoir is loaded with the heat or the energy contained in the extracted high pressure steam this energy may be used in times of very high loads of the turbine 3 for heating the condensate before entering the feed water reservoir 8 and/or before entering the boiler 1 and thus reducing the amount of tapping steam needed in the preheaters VW1 to VW5.

This means that in times of high load or peak load the electric output of the steam power plant can be increased since no or only a little amount of tapping steam is extracted from the medium pressure part IP and/or the low pressure part LP of the turbine 3.

All appliances have in common that the energy contained in the high pressure steam is recovered and therefore the overall efficiency of the steam power plant and other industrial processes is increased.

FIG. 3 shows a second mode of operation of a steam power plant at low load. At this mode steam that has been partially expanded in the high pressure part HP of the turbine 3 is extracted (c.f. line 25) before the steam enters the first reheater RSH1. It is also possible to alternatively or in addition extract steam between the first reheater RSH1 and the second reheater RSH2 (c.f. line 27). Of course the steam parameters (pressure and temperature of the steam) extracted before entering the first reheater RSH1 or the second reheater RSH2 is different from the steam that is extracted between the superheaters SH1 and SH3 (c.f. FIG. 2).

Despite these differences in temperature this steam extracted before or between the reheaters RSH1 and RSH2 may be used in a similar way as has been explained in conjunction with FIG. 2.

In FIG. 4 a third mode of operation is shown combining both the method illustrated in FIGS. 2 and 3. As a result even more stability of temperature and pressure of the live steam LS may be achieved.

It is further possible to reduce in the three described embodiments the pressure of the boiler (c.f. $p_{LS}$) at low load and thus minimize the Joule-Thomson-Effect and the control valves that are part of the high pressure part HP of the turbine 3. The Joule-Thomson-Effect causes a temperature degrease of the steam at the entrance into the high pressure part HP of the turbine 3 and should therefore be avoided.

To sum up, it may be stated that all three modes of operation need to stable steam parameters LS and improve the convective head transfer between the flue gas and the steam in the superheaters SH1 and SH2, SH3 as well as in the resuperheaters RSH2 and RSH1. Since the extracted steam can be used in several heats sinks inside the steam power plant or outside the steam power plant the overall efficiency is maintained at a high level. Since the claim methods do not require great operative amendments, it is possible to apply these methods as a retrofit solution for existing steam power plants.

The invention claimed is:

1. A method for operating a steam power plant including a steam generator, a turbine, a condenser, a condensate line, a first resuperheater, and a second resuperheater fluidly coupled upstream of the first resuperheater; the method comprising:

passing steam through the second resuperheater and then through the first resuperheater after passing through a high-pressure part of the turbine and before entering into a medium-pressure part of the turbine; and extracting a portion of the steam between the first resuperheater and the second resuperheater when the steam power plant is operating at a low load.

2. The method according to claim 1, wherein the steam power plant further includes a first superheater and a second superheater; the method further comprising:

passing steam sequentially through the first superheater and the second superheater before entering into a high-pressure part of the turbine; and extracting a portion of the steam passing between the first superheater and the second superheater when the steam power plant is operating at low load.

3. The method according to claim 1, wherein the extracted portion of the steam is used for loading a heat reservoir, for drying and fluidising coal, supplying one or more of the preheaters with thermal energy, running a separate steam turbine or a steam motor and/or energy supply for industrial processes.

4. A computer program comprising a program that is programmed to control a steam power plant according to claim 1.

5. An electronic storage medium for a control unit of a steam power plant, comprising a computer program according to claim 1 is stored in it.

6. A control unit of a steam power plant programmed to control a steam power plant according to the method of claim 1.

7. The method according to claim 1, further comprising extracting the portion of the steam upstream of the second resuperheater when the steam power plant is operating at low load.

8. The method according to claim 2, wherein the steam power plant further includes a third superheater fluidly coupled between the first superheater and the second superheater; the extracting a portion of the steam further comprising that at low load of the steam power plant extracting the portion of the steam before a last between the first superheater and the third superheater and/or between the second superheater and the third resuperheater of the steam power plant when the steam power plant is operating at low load.

9. The method according to claim 1, wherein the extracting a portion of the steam comprises extracting only a portion of the steam upstream of the first resuperheater when the steam plant is operating at low load.

10. The method according to claim 1, wherein the extracting a portion of the steam comprises extracting a portion of the steam upstream of the first resuperheater to maintain maximal steam temperature when the steam plant is operating at low load.

11. The method according to claim 2, wherein the extracting a portion of the steam passing between the first superheater and the second superheater comprises extracting only a portion of the steam passing between the first superheater and the second superheater to maintain maximal steam temperature when the steam plant is operating at low load.

* * * * *